United States Patent [19]

Boysen et al.

[11] Patent Number: 4,518,125

[45] Date of Patent: May 21, 1985

[54] CRUSHERS

[76] Inventors: Lennart Boysen, Smedjegatan 8, S-384 00 Blomstermåla; Ulf Ottoson, Långemåla, S-570 76 Ruda, both of Sweden

[21] Appl. No.: 437,255

[22] Filed: Oct. 28, 1982

[30] Foreign Application Priority Data

Nov. 12, 1981 [SE] Sweden ..... 8106727

[51] Int. Cl.[3] ..... B02C 19/22

[52] U.S. Cl. ..... 241/141; 241/260.1; 241/285 B

[58] Field of Search ..... 241/101.2, 3, 82.7, 241/82.4, 260.1, 141, 146, 285 A, 151, 152 A, 160, 157, 285 B, 37.5, 32

[56] References Cited

U.S. PATENT DOCUMENTS

| | | | |
|---|---|---|---|
| 1,167,858 | 1/1916 | Thornton | 241/82.7 |
| 1,922,761 | 8/1933 | Dwofsky | 241/82.7 X |
| 3,242,957 | 3/1966 | Provenzano | 241/82.4 |
| 4,000,860 | 1/1977 | Gotham | 241/285 B X |
| 4,040,571 | 8/1977 | Lindeborg | 241/260.1 X |
| 4,214,713 | 7/1980 | Wright | 241/285 B X |

*Primary Examiner*—Mark Rosenbaum

*Attorney, Agent, or Firm*—Hubbell, Cohen, Stiefel & Gross

[57] ABSTRACT

Improvements in crushers, particularly for wood waste, comprise a container (1) having at least one inlet opening (3) and at least one outlet opening (4) for the waste and a plurality of mutually cooperating, feeding and disintegrating screws (6) as well as driving means for rotating the screws. To make possible an extensive disintegration of the material in the crusher each screw is provided at its one end, which is located adjacent to the outlet opening (4) of the container, with a substantially plane cutting means (11) which has at least one cutting edge and is located in a plane, which is substantially perpendicular to the rotational axis of the screw. At least one knife (23) or the like is secured to the container at its outlet opening, closely by the movement path of the cutting means, for further disintegration of the material just disintegrated in the crusher in cooperation with said cutting means.

5 Claims, 8 Drawing Figures

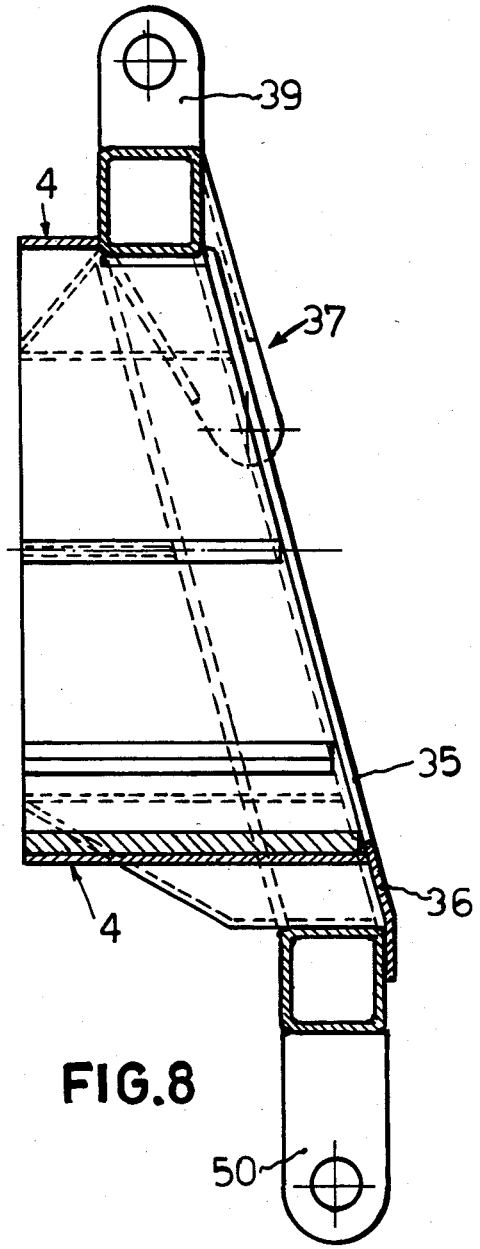
FIG.8
FIG.3
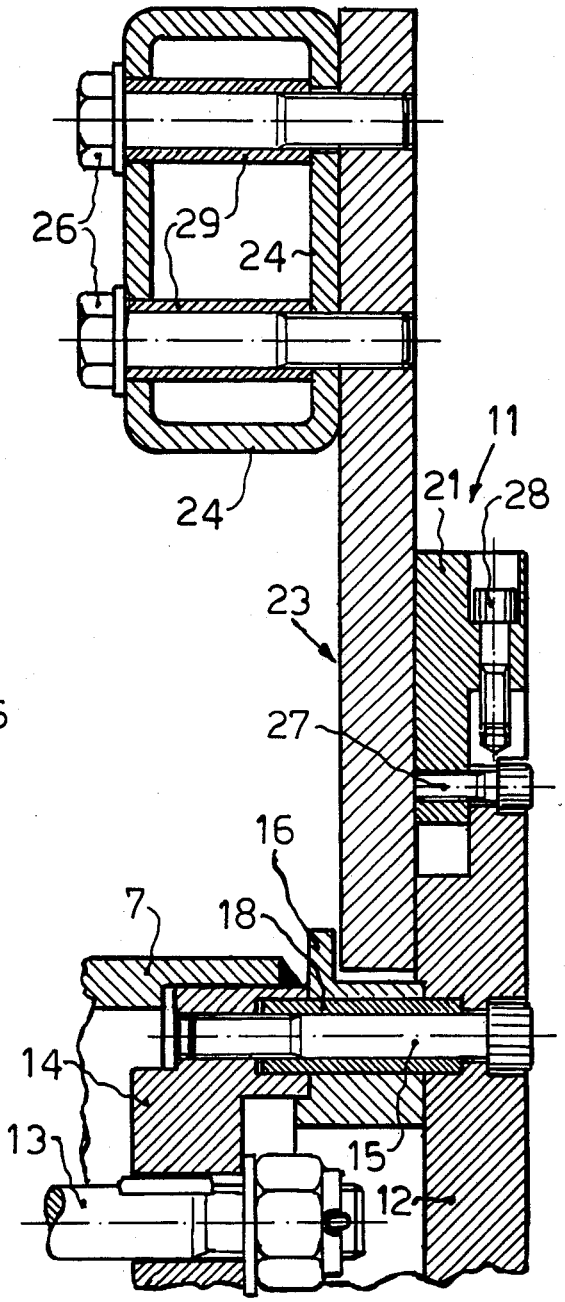

CRUSHERS

BACKGROUND OF THE INVENTION

This invention relates to improvements in crushers or disintegrators of the type generally disclosed in U.S. Pat. No. 4,040,571.

SUMMARY OF THE INVENTION

The principal object of the invention is to provide a crusher of the above kind by means of which it is possible to produce from coarse starting material having a great extension in at least one direction, e.g. wood waste, finely disintegrated wooden or cellulosic material which may be utilized particularly as fuel without further disintegration.

In a particularly advantageous embodiment each cutting means is comprised of a preferably substantially planar circular disc which is secured to the outlet end of the screw and is located in a plane which is substantially perpendicular to the rotational axis of the screw, and has at least one edge cooperating with the knife and passing closely by the knife of the rotation of the disc.

BRIEF DESCRIPTION OF THE DRAWINGS

Further features and advantages of the apparatus according to the invention will become apparent from the following detailed description and the annexed drawings, which diagrammatically and as non-limiting example illustrate a preferred embodiment of the invention.

FIG. 3 is a cross-sectional view on line III—III in FIG. 2.

FIG. 8 is a vertical section on line VIII—VIII in FIG. 7.

DESCRIPTION OF THE PREFERRED EMBODIMENT

Figure 1:
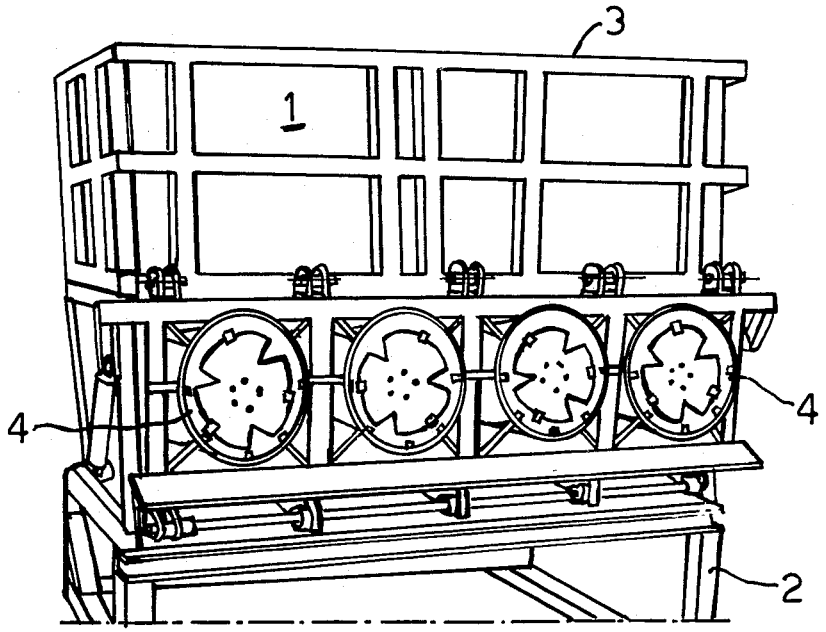
FIG. 1 of the drawings is a perspective view of a crusher which is provided with the improvement according to the invention.

Initially it is pointed out that the Figures of the drawings are drawn on different scales.

The crushing apparatus according to the invention comprises a container 1 which is supported by a framework 2 and in the illustrated embodiment has an inlet opening 3 and four outlet openings 4. In the lower portion of the container 1 there are provided four disintegrating and feeding screws which are generally designated 6 and each comprising a tubular shaft 7 and a helical flight 8. (FIG. 5) Each screw 6 is associated with an outlet opening 4. The screws are rotated by driving means not shown in detail. The bottom of the container 1 is substantially planar except adjacent to its longitudinal walls which are parallel to the axes of the screws and to which the bottom is connected by arcuate portions substantially having the shape of a quarter of a circular cylinder and being coaxial with the screws, from which they are separated by a small interspace.

Figure 4:
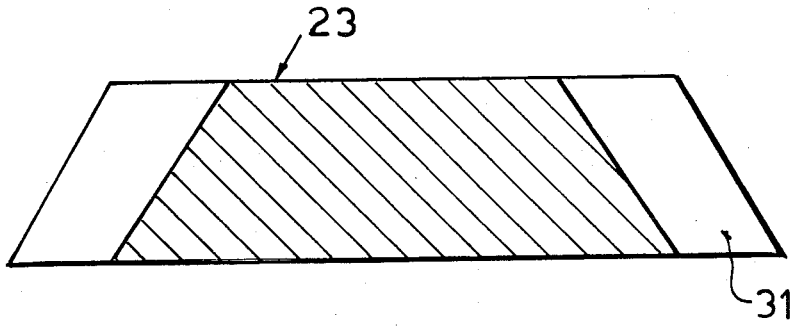
FIG. 4 is a cross-sectional view on line IV—IV in FIG. 2.

According to the invention each screw 6 is at its end located next to the appurtenant outlet opening 4 terminated by a cutter which is generally designated 11 and cooperates with a knife (FIGS. 2–4) secured to the container 1. In the preferred embodiment the cutter (FIGS. 2 and 3) comprises a substantially plane disc 12 which is secured to the tubular axis 7 of the screw which also comprises a central rod 13 which at its end located next to the outlet opening 4 is connected with the circumferential tube of the shaft through a washer 14 by means of eight screws or bolts 15 which are threaded into the washer 14 and pass through an annular spacer 16 and of which at least part are surrounded by clamping or bracing pins 18.

Figure 2:
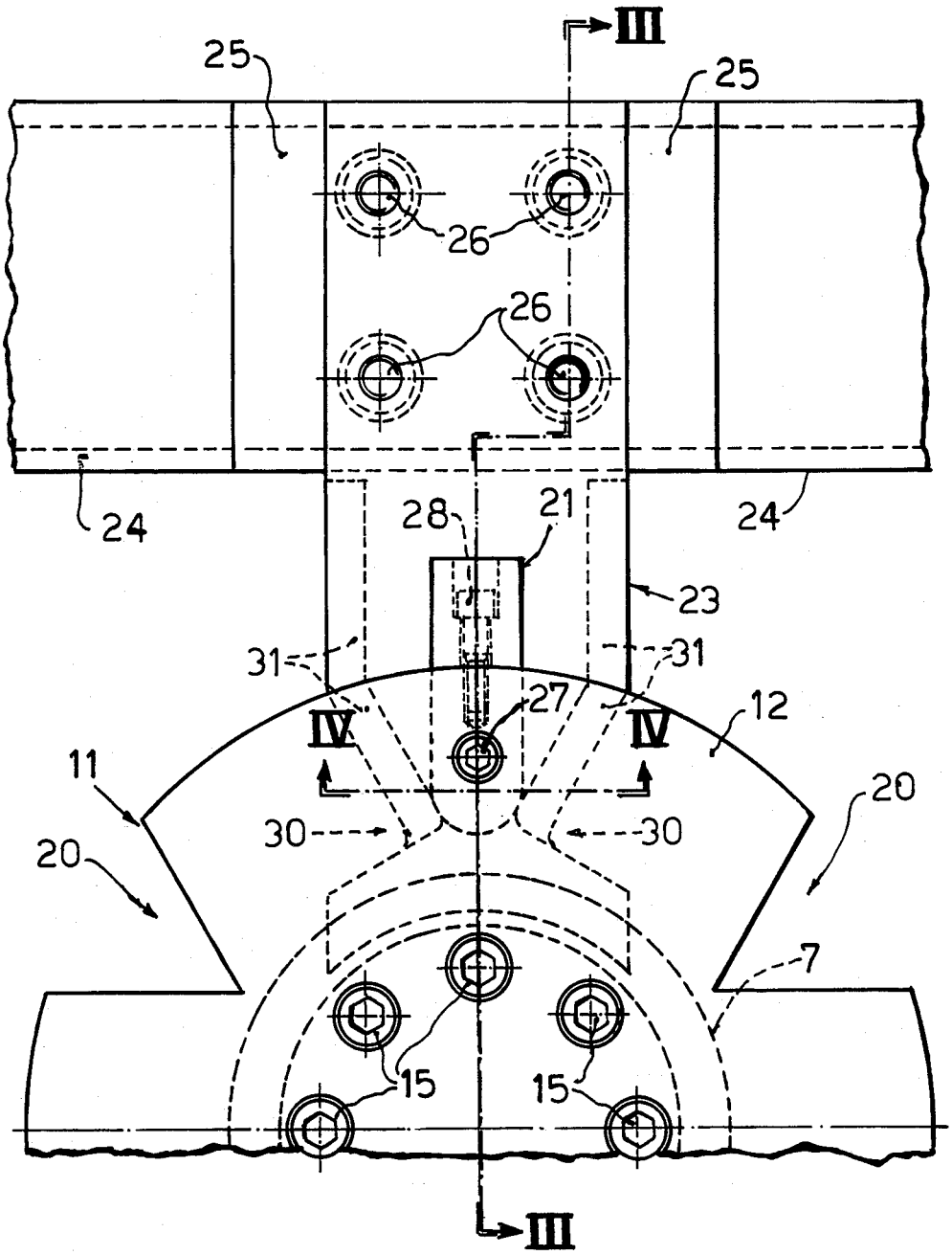
FIG. 2 is a plan view of the knife and that part of the cutting means which is located next to the knife.

As is most clearly shown in FIG. 3 the circumferential portion of the disc 12 is only about half as thick as the central portion of the disc. In the circumference of the disc 12 there are provided three V-shaped recesses 20 (of which only two are shown in FIG. 2) with equal spacing. The two edges of each recess form an angle of about 60° with each other, and the apexes of the recesses are located at a small distance from the tubular shaft 7 of the screw. In the center of the peripheral or outer edge of arc portions of the disc 12 between the recesses 20, a grater 21, which is substantially rectangular as seen in a plan view, is secured to the disc 12 by means of two screws 27, 28. The radially outermost (with respect to the disc 12) portion of each grater 21, which is located outside the circumference of the disc, has the same thickness as the disc, while the radially innermost portion of the grater which is located beside the peripheral portion of the disc, with respect to its thickness substantially equals the difference in thickness between the central portion and the peripheral portion of the disc. The lateral surfaces of the grater 21 and the disc 12 which are perpendicular to the shaft 7 are located in common planes.

The cutter 11 (FIGS. 2, 3 and 5) cooperates with said knife which is generally designated 23 and is secured between two flat irons 25 to a longitudinal box girder 24, which is comprised in the framework 2, by means of four screws or bolts 26 under the intermediary of distance sleeves 29. The knife 23 is substantially rectangular as seen in a plan view and extends in relation to the shaft 7 a little further radially inwards than the recesses 20 of the disc 12. The free end of the knife which is remote from the box girder 24 is concave and defined substantially by a circular arc which is coaxial with the shaft 7, as is most clearly shown in FIG. 2. In the longitudinal sides of the knife there are provided two V-shaped recesses 30 which correspond to the recesses 20 of the disc 12 and are located at substantially the same distance from the rotational axis of the cutter 11 as the last-mentioned recesses. The recesses 30, whose edges form an acute, almost right angle with each other may possibly be omitted. That portion of the longitudinal edges of the knife 23, including at least the radially outermost one of the edges of the possible recesses 30, which is located just opposite the movement paths of the recesses 20 and the graters 21 is bevelled, as is most clearly evident from FIG. 4 and as is also indicated at 31 in FIG. 2. Through the bevelling the knife 23 obtains cutting or shearing edges which are located just opposite and closely by corresponding edges of the recesses 20 of the disc 12 and of the graters 21 and together with the lastmentioned two edge cuts or shears the waste material pre-disintegrated and advanced by the screws 6 into smaller pieces.

Figure 5:
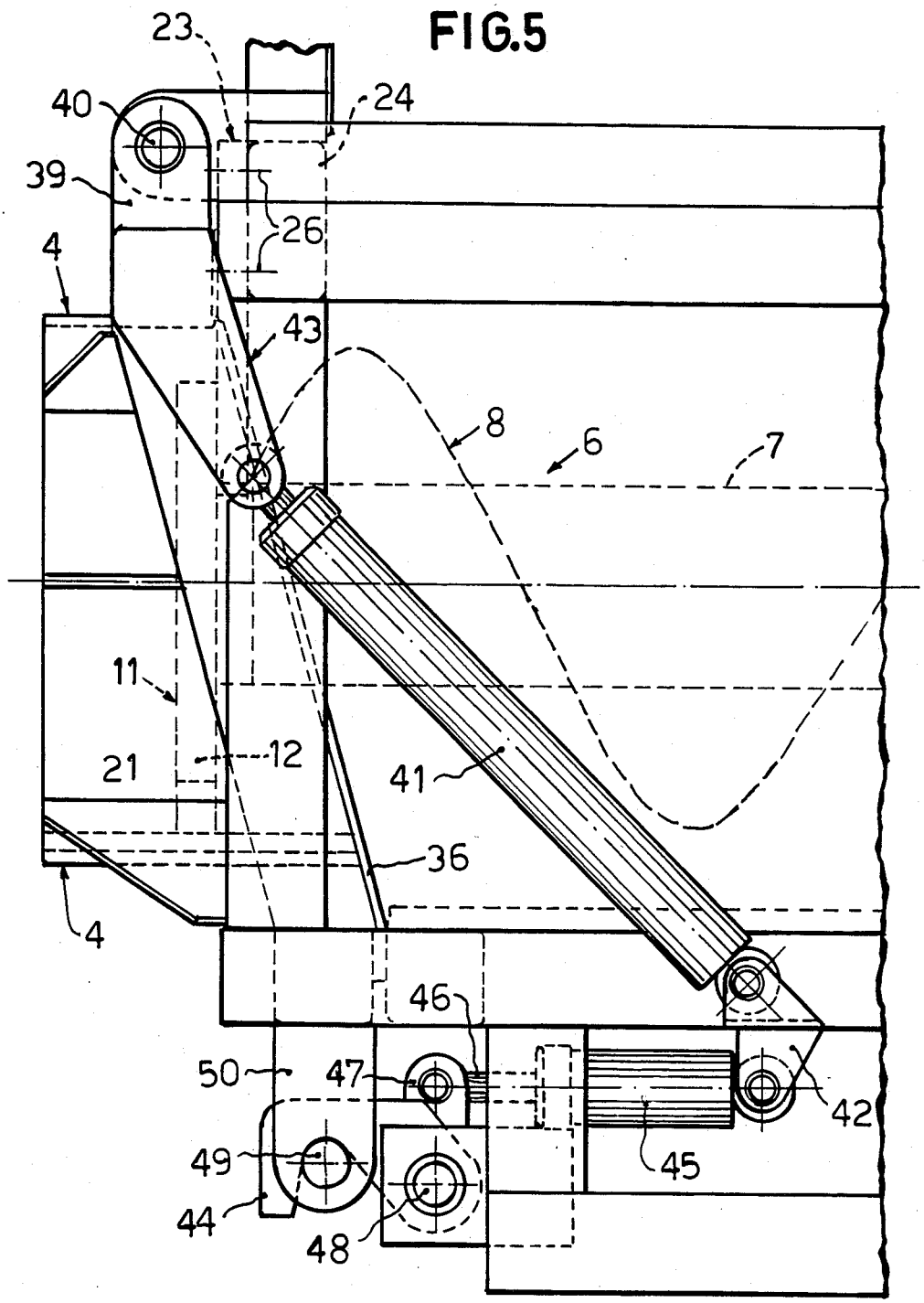
FIG. 5 illustrates in a side view how the knife and the cutter are mounted in a common outlet opening.
Figure 6:
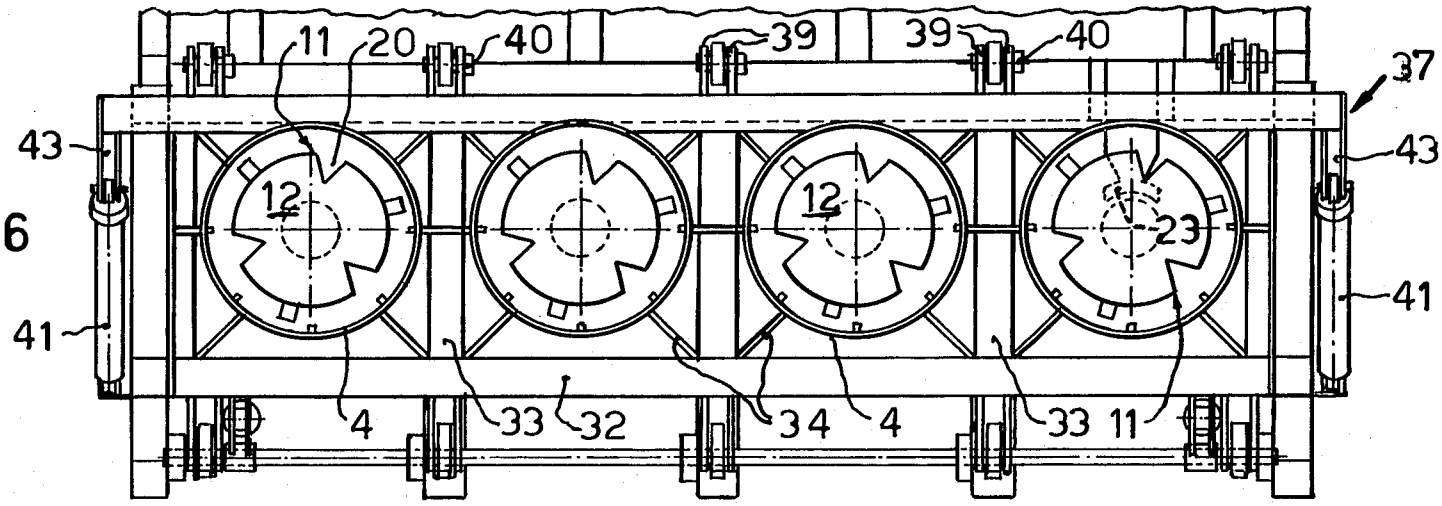
FIG. 6 is a plan view illustrating outlet openings connected in parallel and cutters provided therein as well as surrounding details in a view corresponding to FIG. 5.
Figure 7:
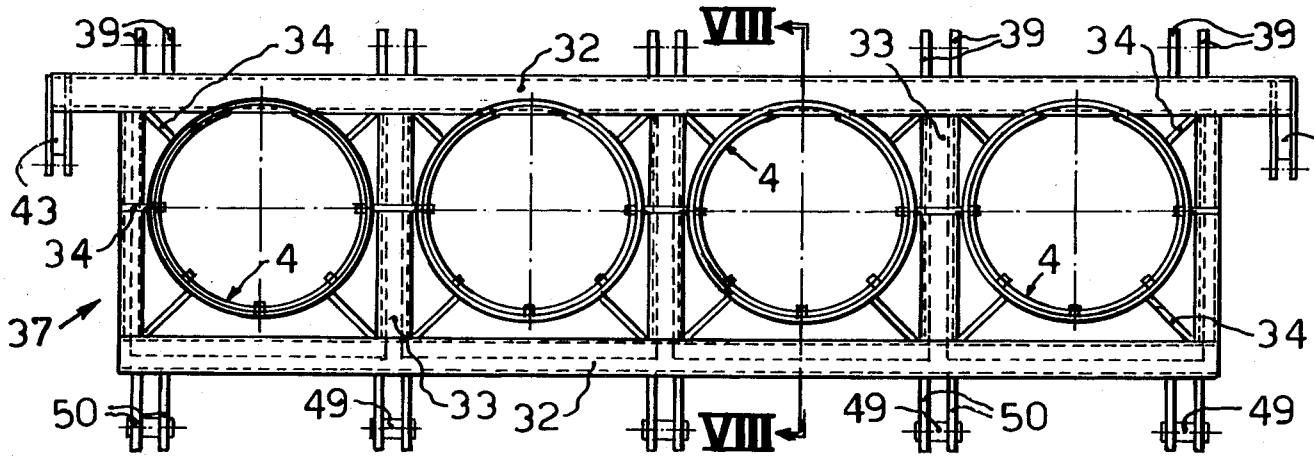
FIG. 7 is a plan view of a door or shutter, in which the four outlet openings according to FIG. 6 are provided.

As is mentioned above, the cutters 11 and the knives 23, which are four in number in the illustrated embodiment, are arranged in immediate proximity to the outlet openings 4 of the container 1. According to an advantageous further development of the invention the outlet openings 4 are formed of short tubes which surround their respective cutters 11 and knives 23 and are bevelled at their inner end, at which they are secured to a common, tilted plate 36 which is provided with openings 35 for the screws 6 (FIGS. 5 and 8). The plate 36 can be considered as the end wall of the container 1 and constitutes a restriction plate for the screws 6. By means of flanges 34 the four tubes 4 (FIGS. 6 and 7) are secured in a common door or shutter which is generally designated 37 and is most clearly shown in FIGS. 7 and 8. The shutter 37 comprises a framework consisting of longitudinal beams 32 and cross beams 33 to which the flanges 34 are welded. By means of five pairs of bearing lugs 39 the door 37 is pivotable on mutually coaxial bearing studs 40 (FIG. 6) which cooperate with respective pairs of bearing lugs. For rotating the door 37 there is provided a pair of hydraulic jacks 41 having their piston cylinders rotatably attached to a cylinder support 42 and their piston rods articulated to a lever 43 which is welded to the upper longitudinal beam 32 of the framework. For the locking of the door 37 in its closed position, in which the tubes 6 are coaxial with the screws 6 latches 44 (FIG. 5) are provided which in the closed position engage studs 49 between ears 50 which are pairwise welded to the lower longitudinal beam 32. The latches are operated by hydraulic jacks 45 whose piston rod 46 is rigidly connected with the pivot shaft 48 of the latch 44 by means of a lever 47. When the door 37 is opened, the cutters 11, the knives 23 and those ends of the screws 6 which are located next to the outlet openings 4 become accessible.

The embodiment described above and illustrated in the drawings is, of course, to be regarded merely as non-limiting example and may as to its details be modified in several ways within the scope of the following claims. In particular, the number of screws, cutters and knives may be another one than that illustrated. Furthermore, the cutters may be free from graters 21 or recesses and consequently have only recesses or graters, respectively. The graters 21 may also be made integral with the respective discs 12.

What we claim is:

1. In an improved crusher for solid waste such as woodwaste and other wood containing waste material, said crusher being of the type comprising a container having at least one inlet opening and at least one outlet opening for the waste and a rotatable waste feeding and disintegrating screw extending between said inlet and outlet; wherein the improvement comprises a plate pivotally mounted on said container for movement between an operative and retracted position, a tube mounted on said plate in a position so that it is in axial alignment with said screw when said plate is in said operative position for defining said outlet opening, a cutting means comprising a planar cutter fixedly mounted on the end of said screw and being disposed within said tube when said plate is in said operative position, whereby said cutting means can be freed from non-crushable material by pivoting said plate from said operative position toward said retracted position.

2. The crusher of claim 1, further comprising a second screw in said container parallel with said first screw, a second tube mounted on said plate in a position so that said second tube is in axial alignment with said second screw when said plate is in said operative position for defining an outlet for said second screw, and a second cutting means comprising a second planar cutter fixedly mounted on the end of said second screw and being disposed within said second tube when said plate is in said operative position.

3. The crusher of claim 2, wherein said first and second cutting means each further comprise a knife means fixed to said tube and disposed to cooperate with its respective cutter when said plate is in said operative position.

4. The crusher of claim 3, wherein both said cutters are circular discs each of which includes a grater projecting outwardly from the circumference thereof, each said grater having a leading edge for cooperation with its associated knife means.

5. The crusher of claim 1, wherein said cutting means further comprises a knife means fixed to said tube and disposed to cooperate with said cutter when said plate is in said operative position.

* * * * *